United States Patent [19]

Hernandez

[11] 4,361,228

[45] Nov. 30, 1982

[54] NOVEL CONTAINER TO IMPREGNATE SHAVING BRUSHES

[76] Inventor: Alexander J. Hernandez, 2632 St. George St., Los Angeles, Calif. 90027

[21] Appl. No.: 183,280

[22] Filed: Sep. 2, 1980

[51] Int. Cl.[3] ..... B65D 85/14; B65D 51/24

[52] U.S. Cl. ..... 206/216; 206/77.1

[58] Field of Search ..... 206/216, 77.1, 1.7, 206/1.8, 277

[56] References Cited

U.S. PATENT DOCUMENTS

| | | | |
|---|---|---|---|
| 328,020 | 10/1885 | Schweickert | 206/77.1 |
| 970,779 | 9/1910 | Arnone | 206/77.1 |
| 2,528,530 | 7/1950 | Machleder | 206/1.7 |
| 2,756,530 | 7/1956 | Nelson | 206/1.8 |

FOREIGN PATENT DOCUMENTS

| | | | |
|---|---|---|---|
| 1246793 | 10/1960 | France | 206/1.8 |

*Primary Examiner*—William T. Dixson, Jr.
*Attorney, Agent, or Firm*—Oblon, Fisher, Spivak, McClelland & Maier

[57] ABSTRACT

A container attachable to a shaving cream tube having a cap for impregnating a shaving brush includes a container having a geometric revolving configuration which is tubular, cylindrical and hollow, its diameter being greater than its height, having its larger base open and an external and perimetric thickening of circular contour, and its lower base having round edges, the wall of which closes inwardly and upwardly in a tapered fashion, of triangular cross-section, defining a truncated, hollow cone-shaped space, the larger base of which is a circumference and the smaller base of which configures a circular, cylindrical hollow opening, allowing for free access between the truncated cone-shaped space and the inside of the container, which opening is arranged in a concentric form with respect to the circumference of the larger base and the container, the opening having in addition in its internal periphery a female thread to receive the male thread of a conventional shaving cream tube and a cap element having a tubular, cylindrical hollow body projecting longitudinally therefrom, the cylindrical tubular body including a member for holding the tube cap which includes a hollow portion formed in the body defining a cylindrical and tubular space within which the tube cap is housed.

1 Claim, 10 Drawing Figures

NOVEL CONTAINER TO IMPREGNATE SHAVING BRUSHES

BACKGROUND OF THE INVENTION

1. Field of the Invention

This invention relates to a novel container for impregnating shaving brushes with the shaving cream contained in a conventional tube and, more specifically, relates to a container to be applied to shaving cream tubes, thus allowing a better and handier use of said creams.

2. Description of the Prior Art

Shaving creams are sold in cylindrical, flexible tubes having an opening provided with a removable, threaded cap. When the user uses the content from such tubes, he takes off the cap and with his fingers presses on the flexible, cylindrical body so that the cream comes out of the opening, in a quantity depending on the pressure exercised on the body of the package.

The use of these shaving cream packages has the disadvantage that it is neither handy nor easy for user to impregnate the shaving brush with the outcoming cream, the user having to utilize a separate bowl to pour directly therein the amount of cream he thinks he will be using or, if the cream has been placed directly on the shaving brush, the user puts some into the bowl to stir the cream so that it impregnates the brush evenly. All this procedure, in addition to being highly bothersome, gives rise to a considerable waste of shaving cream.

SUMMARY OF THE INVENTION

The object of this invention is to provide a novel and original container which overcomes all the obstacles listed above, allowing the user to disperse the shaving cream directly from the commercial tube containing it into the container object of this invention, to which it adheres by threads, facilitating impregnation of the shaving brush without having a separate container or bowl therefor, with the resulting savings in cream, since no more wastes originate, and more convenience and ease in daily shavings.

For a better understanding of the invention a preferred embodiment will be described, it being understood that said preferred embodiment does not in any way have a limitative purpose, it being described only by way of illustration, and, therefore, modifications or alterations may be made without altering in any way the spirit and scope of the present invention.

BRIEF DESCRIPTION OF THE DRAWINGS

For a better illustration of this invention and its preferred embodiment, reference will be made to the accompanying drawings which form an integral part hereof and which will fill any omission which may be made during such a description wherein.

FIGS. 9 and 10 are perspective views showing a conventional shaving cream tube threaded to the container of FIG. 1, in FIG. 9 without the cap element and in FIG. 10 with it on.

DETAILED DESCRIPTION OF THE PREFERRED EMBODIMENT

Figure 1:
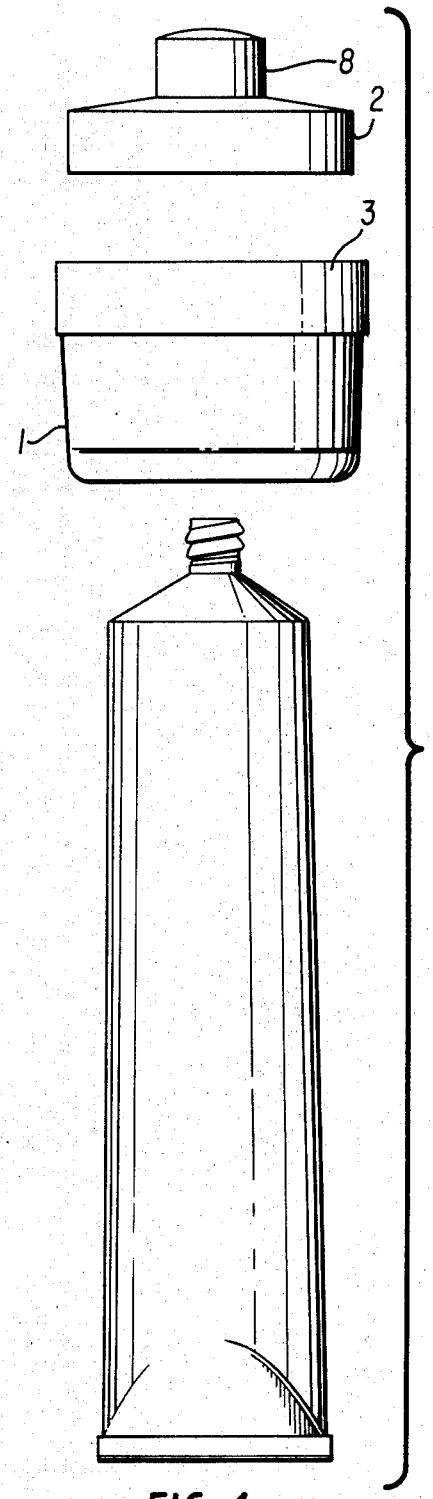
FIG. 1 is an elevated, side view showing the shaving cream container in accordance with the present invention, its corresponding cap element and a conventional shaving cream tube.

As shown in the drawings, the shaving brush-impregnating container of this invention includes two pieces or elements, to-wit , the very container, generally identified in the drawings with reference numeral 1, and a cap element, identified with reference number 2.

The container 1 has a geometric configuration of revolution about axis 12, is tubular, cylindrical and hollow. Its diameter is larger than its height. It has a lower base 9, and a circumferential external radial thickening 3. The edges of its lower base are round. A wall 4 tapers upwardly and inwardly, with a triangular cross-section, defining a truncated, hollow tapering cone-shaped space 5, the outer base 10 of the wall 4 is a circumference. The inner base 11 of the wall 4 configures a cylindrical, hollow circular opening 6 which allows for free access from truncated tapering cone-shaped space 5 to inside of the container, which opening is arranged in a concentric manner with respect to the outer circumference of the base 10 and with respect, also to the tubular, hollow cylinder constituting container 1.

Figure 2:
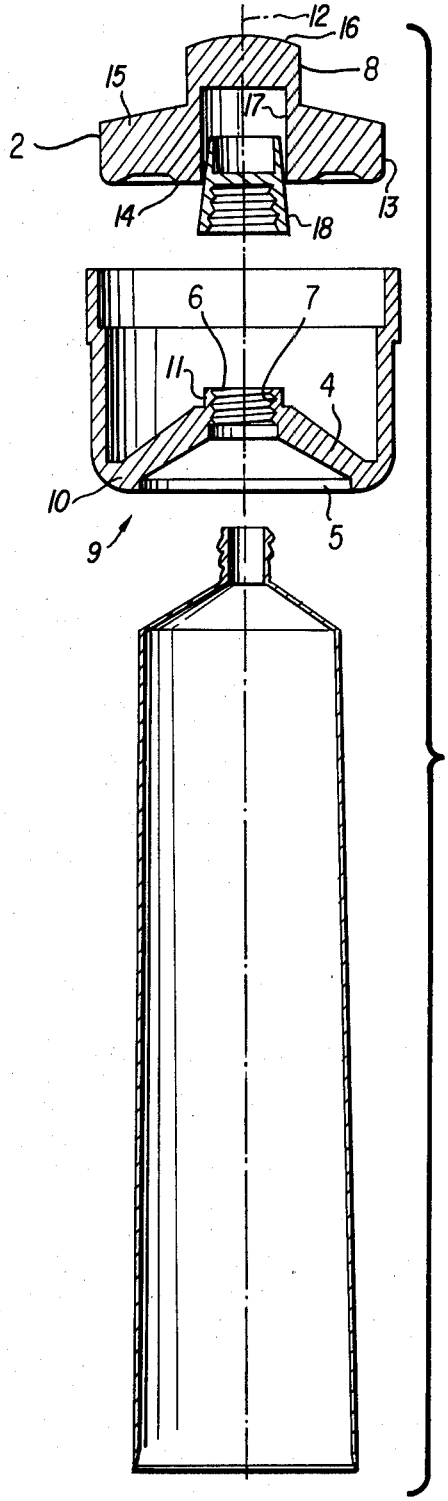
FIG. 2 is a similar view to FIG. 1, but illustrating the container and its cap in a cross-section.
Figure 5:
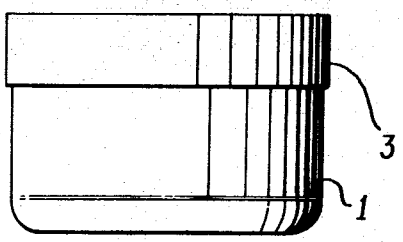
FIG. 5 is a side, elevated view of the container itself.
Figure 8:
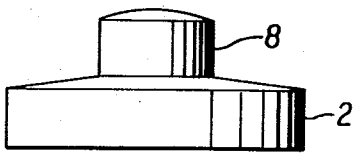
FIG. 8 is a side, elevated view of the cap element in FIGS. 6 and 7.
Figure 4:
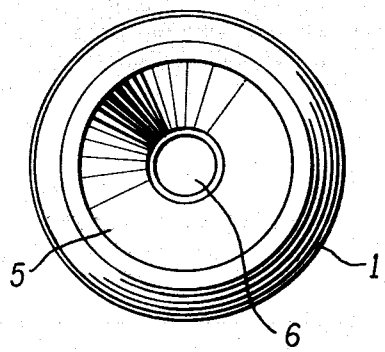
FIG. 4 is a lower view of the container in FIG. 1.
Figure 7:
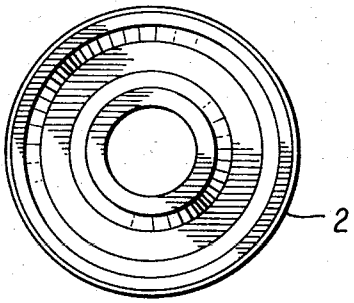
FIG. 7 is a lower view of the cap element in FIG. 6.
Figure 3:
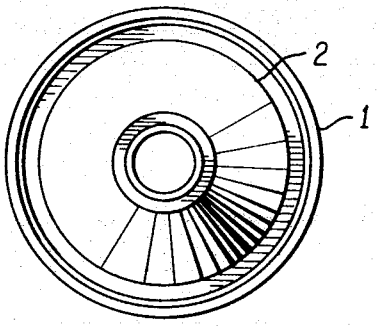
FIG. 3 is a top view of the container in FIG. 1.
Figure 6:
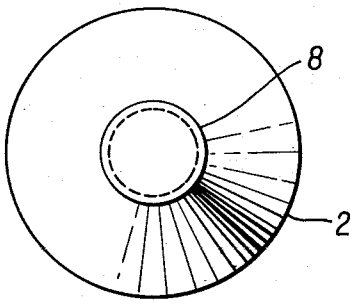
FIG. 6 is a top view of the cap element of the container.
Figure 9:
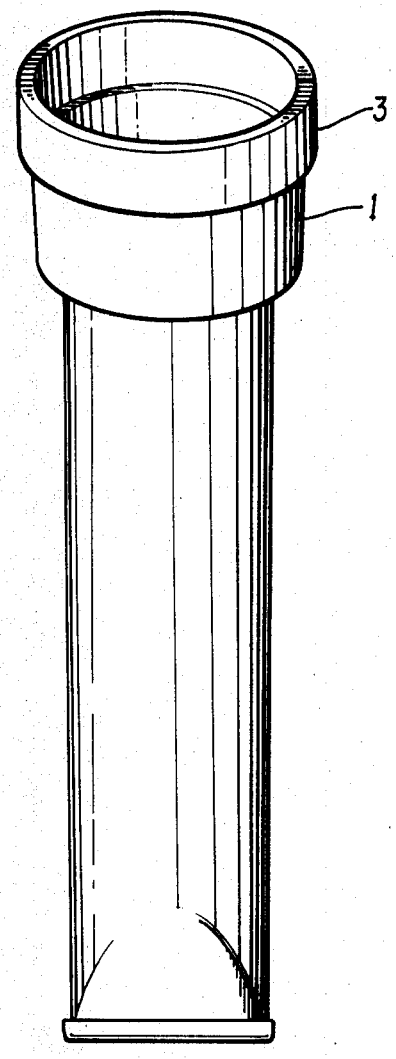
Figure 10:
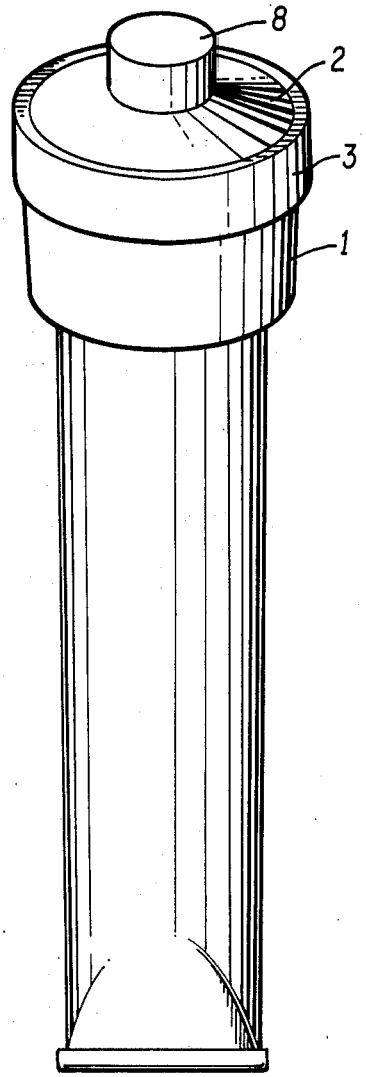

Truncated tapering cone-shaped space 5 has such a shape as to permit it to receive, in an adjusted surface relation, the upper portion of a tube containing shaving cream which is conventionally tapered outwardly, and having a cylindrical, hollow service opening, which projects in a concentric form with respect to the tube, as illustrated in the lower portion of FIG. 2. With this purpose in mind, the portion of the upper truncated vertex of space tapered inwardly 5 of container 1 has in its internal periphery a female thread 7 to threadly receive the cylindrical service opening of the tube containing shaving cream. This thread has a configuration similar to the peripherically internal female thread of the conventional cap which normally closes the shaving cream tube, so that the tube may be arranged threadly in truncated space 5, remaining there in an airtight manner when completely threaded in female thread 7, with the external periphery of its wall tilted thus making an airtight seal with the externally tilted walls of truncated space 5 of container 1. Which impedes that after installing and threading the shaving cream tube in the container 1, the cream cannot leak or filter through this airtight link, but it must obligatorily pass, when pressure is exercised on the body of the shaving cream tube, into container 1 defined by the cylindrical side walls of same.

Given the configuration in the shape of a truncated, tapered cone which portion 5 of container 1 has, its bottom wall internally exhibits a convex configuration, which configuration makes shaving cream entering container 1 through cylindrical and hollow circular opening 6, and from the conventional cream tube, to accumulate in the circular space defined in the joint formed by the tilted walls and cylindrical vertical walls of container 1. This makes the task of the user to impregnate the shaving bruch with shaving cream easy owing to this tendency to flow to the sides of the container.

Cap element 2 includes a revolving body of revolution 13 having a diameter greater than its height, and its height being less than that of container 1, and having its external diameter smaller than the internal diameter of container 1, in order to be concentrically received in same, having its lower end 14 open and including a gradation on its upper end 15 to link, in a tapered manner, to the tubular, hollow cylindrical portion or body 8 prolonged upwards, having a greater diameter than its height but a greater height than the body 13 of the cap element arranged in a concentric form thereto. The upper end 16 base of the body 8 ends as a sphere cap. Internally as seen in the upper part of FIG. 2, the lower end 14 of cylindrical body 13 is open, thus defining a cylindrical, tubular space 17, in which space is received the conventional cap 18 of the shaving cream tube, when it is threaded to container 1, which conventional cap is no longer useful but the conservation of wich may serve to reuse it with the same purpose in case the tube is intended to be taken on a trip or in any occasion when it is considered necessary to separate the shaving cream tube from container 1 object of this invention.

From the foregoing it is evident that when the user wishes or needs to use the container of this invention, he takes a conventional shaving cream tube and after taking off its cap threads it to the tubular, cylindrical opening 6 through the female thread 7, and tightens it with sufficient pressure to establish an airtight seal between the tilted surfaces of the tube and of the container. In order to impregnate the shaving brush with shaving cream, pressure is exercised on the body of the tilted tube making the cream to flow through opening 6, which tends to deposit on the cylindrical lateral portion. Then user introduces into container 1 the brush and impregnates it with previously deposited cream thorugh circular movements; thereafter, after shaving, he places the cap element 2 concentrically into container 1, the shaving cream in the conventional tube and that unused in the lower, lateral circular space of container being thus protected, which, in this case, by using the present invention, is not wasted.

What is claimed as new and desired to be secured by Letters Patent of the United States is:

1. A container attachable to a shaving cream tube for impregnating a shaving brush, said tube having screw threads and a cap, said container comprising:

a container wall defining a hollow cylinder having a first longitudinal axis, an inner surface, an outer surface, an upper axial end and a lower axial end, wherein the diameter of said cylinder is greater than the axial height thereof, wherein said upper end of said container wall defines a perimetric thickening having an external diameter greater than said diameter of said cylinder; and wherein said lower end of said container wall is open with rounded edges;

a base wall fixed to the inner circumference of said lower end and tapering radially inwards and towards said upper end so as to close said lower end and to define a truncated cone shaped space;

a cylindrical opening having walls defined by the radially innermost portion of said base wall, said opening being concentric with said container wall and separating said cone shaped space from the interior of said container;

screw threads on said cylindrical opening walls, said screw threads being matable with said screw threads of said tube;

a first body defined by a solid of revolution about a second axis, the axial height of said first body being less than said height of said container, the diameter of said first body being smaller than the diameter of said inner surface of said container wall, said first body having axially upper and lower ends, said upper end of said first body tapering radially inwardly and away from said lower end of said first body;

a second body defined by a cylindrical body coaxial with said first body, said second body having a lower axial end merging with said upper end of said first body, and a convex curved upper end, the diameter of said second body being greater than the axial height thereof, the height of said second body being greater than the height of said first body, said first and second bodies together defining a cap for said container; and means for holding said tube cap, said means for holding comprising a cylindrical hollow coaxial with said first and second bodies and extending from said lower end of said first body towards said upper end of said second body, said tube cap being housed in said hollow.

* * * * *